US006000546A

United States Patent [19]

Noble

[11] Patent Number: 6,000,546

[45] Date of Patent: Dec. 14, 1999

[54] LOCKABLE PILL CONTAINER

[75] Inventor: Terrance O. Noble, Burnsville, Minn.

[73] Assignee: Apothecary Products, Inc., Burnsville, Minn.

[21] Appl. No.: 09/108,696

[22] Filed: Jul. 1, 1998

[51] Int. Cl.[6] ..... B05D 83/04

[52] U.S. Cl. ..... 206/538; 206/1.5; 206/539

[58] Field of Search ..... 206/1.5, 533, 538, 206/539, 540; 220/23.2, 833, 325, 524

[56] References Cited

U.S. PATENT DOCUMENTS

| | | | |
|---|---|---|---|
| 3,537,422 | 11/1970 | Moe | 220/23.2 |
| 4,048,050 | 9/1977 | Hillman | 206/1.5 |
| 4,062,445 | 12/1977 | Moe | 206/538 |
| 4,730,731 | 3/1988 | Allison | 206/1.5 |
| 4,793,492 | 12/1988 | Hallbich | 206/538 |
| 4,872,559 | 10/1989 | Schoon | 206/538 |
| 5,163,559 | 11/1992 | Bunin | 206/1.5 |
| 5,379,899 | 1/1995 | Thurell | 206/1.5 |
| 5,437,390 | 8/1995 | Romick | 206/538 |
| 5,806,670 | 9/1998 | Harlan et al. | 206/538 |

FOREIGN PATENT DOCUMENTS

| | | | |
|---|---|---|---|
| 2628717 | 9/1989 | France | 206/1.5 |
| 2088335 | 6/1982 | United Kingdom | 206/1.5 |

*Primary Examiner*—Paul T. Sewell
*Assistant Examiner*—Jila Mohandesi
*Attorney, Agent, or Firm*—Merchant & Gould P.C.

[57] ABSTRACT

A lockable pill container is disclosed including a main body with a plurality of individual compartments for receiving pills. Each compartment has a lid member connected to the main body by a hinge permitting it to be moved between open and closed positions. Each lid member has a downwardly projecting hook member that projects through an opening in the main body when the lid is closed. An elongated locking member is laterally inserted into the main body and transversely moveable relative to the hook members between first and second positions. In the first position, the elongated locking member engages the hook members of those lid members that are closed to lock them in the closed position. In the second position, the elongated locking member does not engage the hook members which may be opened and closed without the locking function. The elongated locking member is normally biased into the locking position by a transverse member that includes a downwardly projecting, externally accessible transverse member. The transverse member is formed from resilient material, which normally biases the elongated locking member to its first or locking position. The user may press the transverse member and thus move the elongated locking member against the bias to the second or nonlocking position. The elongated locking member may be selectively removed from the pill container to render the locking feature inoperative if the pill container is used in an environment where locking is not necessary.

17 Claims, 7 Drawing Sheets

LOCKABLE PILL CONTAINER

FIELD OF THE INVENTION

The present invention relates generally to pill containers and is specifically directed to a pill container with a lockable feature.

BACKGROUND OF THE INVENTION

For persons who need to take medicine regularly, the need for a pill container that can be easily carried is highly important. A pill container which is easy to use, has sufficient capacity for the patient's needs, and which can be conveniently carried by the user increases the likelihood that the user will take the correct medicine at the correct time.

Some pill containers are provided with child restraints in the form of locking mechanisms. It is important that a child restraint locking mechanism be durable and that it provide a reliable restraint against children inadvertently opening the pill container. On the other hand, the child restraint should not present increased difficulties for people with, for example, limited ability to use the pill container. That is, pill containers which include minute controls for child restraint and/or lids that must be gripped with fingertips to open often present increased handling difficulties for people suffering from, for example, rheumatism or arthritis. Many patients who responsibly keep their pill container away from children may prefer that the child restraint be removed, enabling the device to be accessed more easily.

In many pill containers, the user opens a lid, cover or equivalent structure to access a compartment that contains the medicine that is about to be taken. Because the opening of the compartment is typically so small that the patient cannot conveniently take out the medicine tablets with one or two fingers, or at least cannot do so without destroying one or more of the medicine tablets, the patient may cup his or her hand over the opening of the compartment and turn the medicine storage device upside down, hoping to catch the medicine tablets in the cupped hand.

Known pill containers also frequently include multiple storage compartments with each compartment corresponding to a different day of the week. It is also common to put symbols or numbers written in Braille on the medicine storage device to aid a visually impaired patient in taking his or her medicine on the right day.

SUMMARY OF THE INVENTION

The preferred embodiment of the invention consists of a pill container having a main body with a plurality of lid members capable of closing separate compartments in the main body, and a longitudinally extended engagement member which can be inserted into the main body to engage at least one hook member on the lid members to lock the lid members in a closed position. The main body further includes a bottom element, first and second side elements, a plurality of dividing elements, a back element and a front member, together forming the plurality of separate compartments in the main body.

One advantage of the invention is that it provides an easily accessible portable medicine storage device. Another advantage is that the inventive pill container can be provided with a conveniently operating child restraint which does not occupy the storage space of the separate compartments, and which can conveniently be removed by an adult user if desired.

These and various other advantages and features of novelty which characterize the invention are pointed with particularity in the claims hereto and forming a part hereof. However, for a better understanding of the invention, its advantages, and the objects obtained by its use, reference should be made to the accompanying drawings and descriptive matter which form a further part hereof, and in which there is illustrated and described a preferred embodiment of the invention.

BRIEF DESCRIPTION OF THE DRAWINGS

In the drawings, wherein corresponding reference numerals generally indicate corresponding parts throughout the several views.

DETAILED DESCRIPTION OF THE DRAWING

Figure 1:
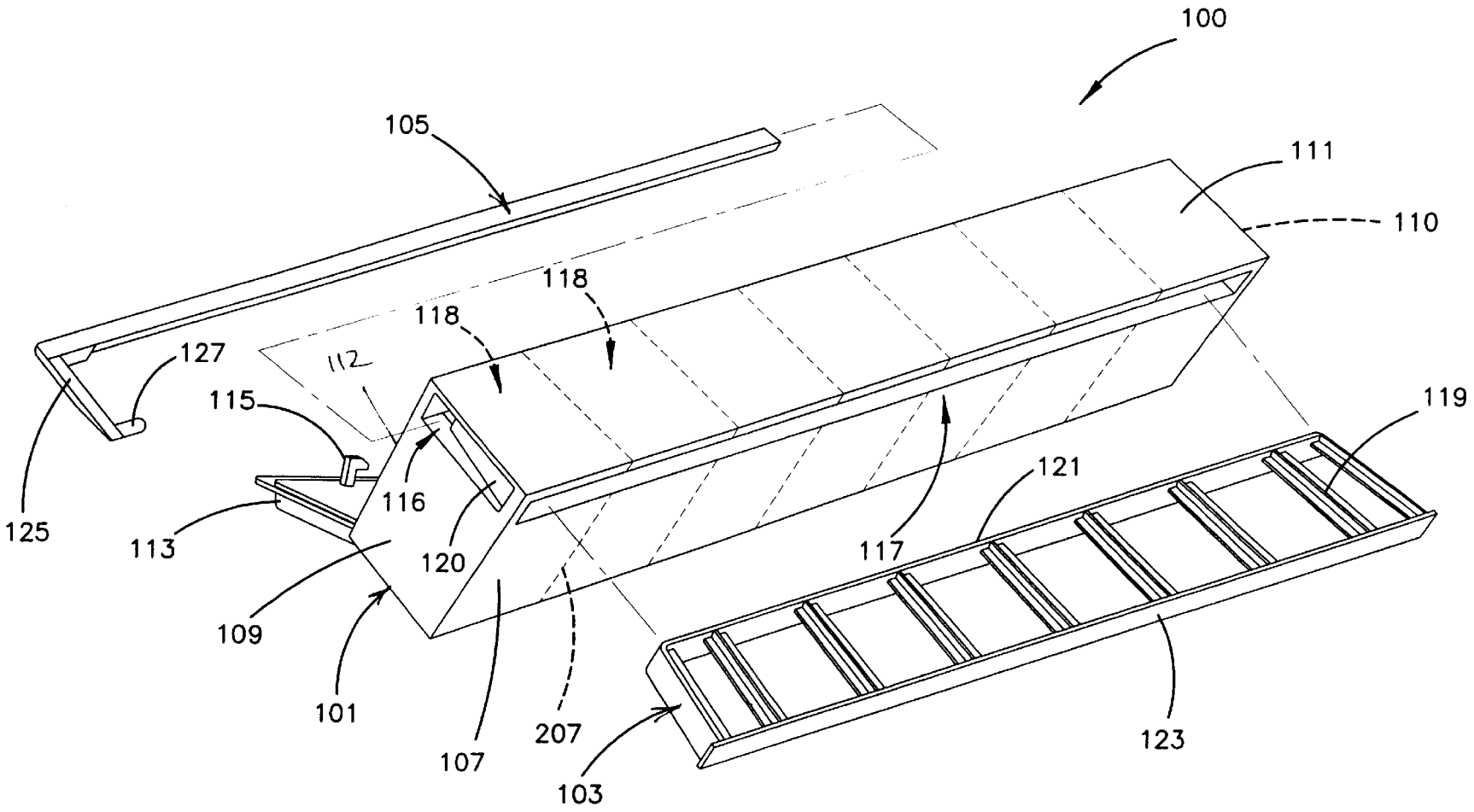
FIG. 1 is an isometric view of an embodiment of a portable medicine storage device according to the invention.

FIG. 1 shows an exemplary portable medicine storage device 100 in the form of a multi-compartmental pill container. The device 100 generally consists of a main body 101, a longitudinally extended locking engagement member 105 and a longitudinal support member 103. The main body 101 includes a bottom element 107, a first side element 109, a second side element 110, a front member 111, a top member 112 and a plurality of lid members 113. The main body 101, the engagement member 105 and the support member 103 as well as the various parts which they include, may all be manufactured from a number of different materials. For example, many plastic materials, such as polyethylene may be used with embodiments of the invention. The parts of the device may all be manufactured using well known techniques, an example of which is plastic injection molding.

Inside the main body 101 a plurality of dividing elements 207 are located, thus forming a plurality of separate pill storage compartments 118 in the main body 101. In the preferred embodiment the compartments are linearly disposed.

Each of the plurality of lid members 113 is constructed and sized to close one of the separate compartments 118. Each lid member 113 includes a hook member 115 extending perpendicularly beneath the lid member 113. The hook members 115 are engageable by the locking engagement member 105 to lock the lid members 113 in a closed position.

The longitudinally extended engagement member 105 includes a transverse portion 125 at one end, substantially perpendicular to the main part of the engagement member 105. The transverse portion 125 includes a spacer 127, situated substantially at the outer end of the transverse portion 125 and extending in a direction generally parallel with the main part of the engagement member 105. The engagement member 105 is insertable into the main body 111 through an opening 116 in the first side element 109. When inserted into the main body 101, the engagement member 105 can engage and disengage the hook members 115 of the lid members 113 to hold at least one lid member 113 in a closed position. When the engagement member 105 has been inserted into the main body, the transverse portion 125 extends in a substantially downward direction toward the bottom element 107. The spacer 127 engages a recessed portion 120 of the first side element 109. The configuration of the engagement member 105 where the transverse portion 125 extends in a substantially downward direction with respect to the device has the advantage that it does not encroach upon the space of any of the compartments in the main body.

To aid the engagement member 105 in engaging and disengaging the hook member 115, the support member 103 is inserted into the main body 101 through a narrow longitudinal slot or opening 117 formed in the bottom element 107. The support member 103 includes a top longitudinal rail member 121, a bottom longitudine1 rail member 123 and a plurality of spaced, transverse support ribs 119 extending between the top and bottom longitudinal members 121 and 123. The support member 103 is inserted into the opening 117 of the main body 101 with the top rail member 121 first. The opening 117 has a uniformly rectangular cross-section in the main body 101. The width of the transverse ribs 119 slightly increases from the top rail member 121 to the bottom member 123 (see FIGS. 5C and 5D). When the support member 103 is inserted into the opening 117 the engagement between the ribs 119 and the interior wall surfaces of opening 117 causes the support member 103 to be frictionally retained inside the main body 101, but it can easily be removed by hand.

Figure 2:
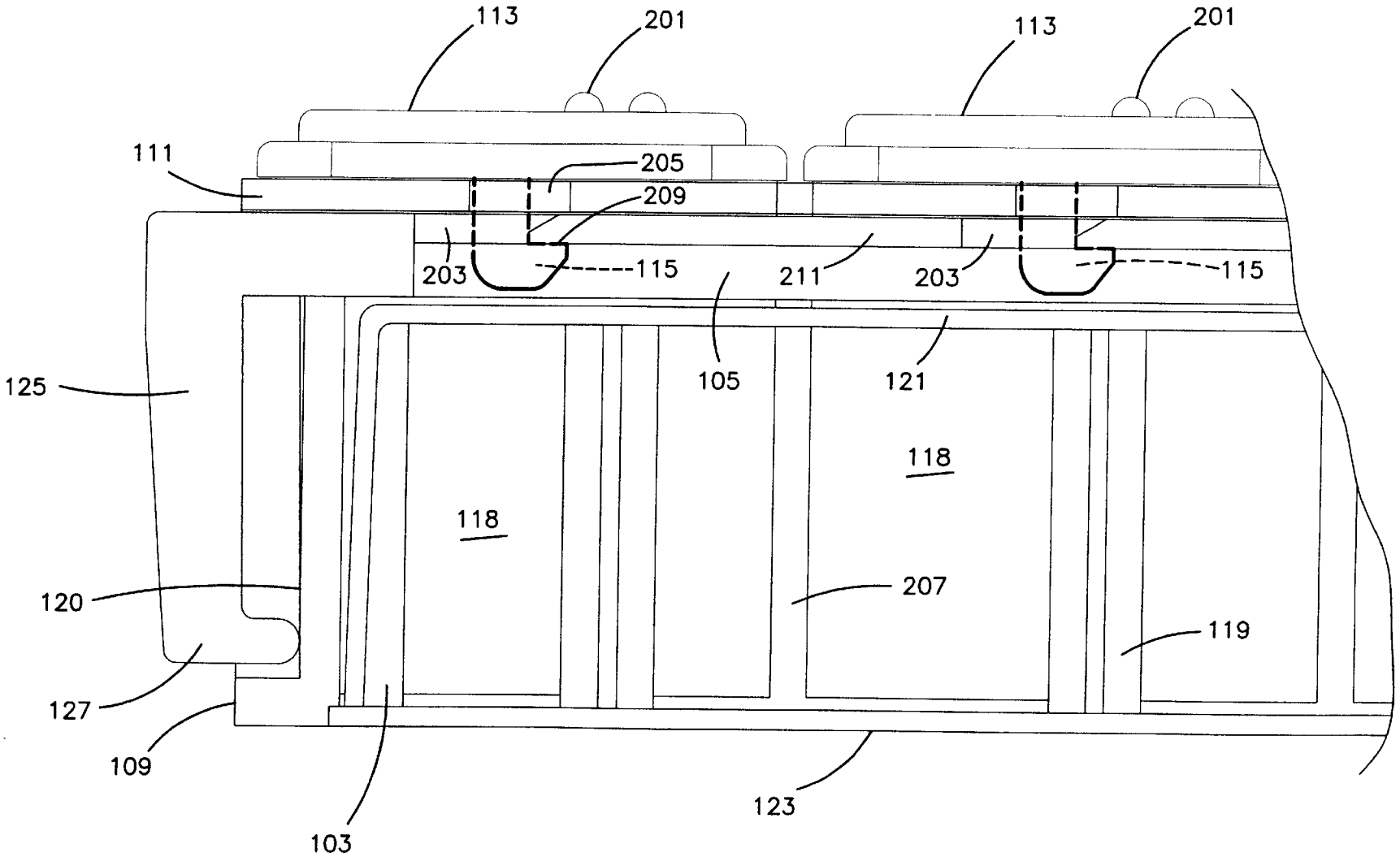
FIG. 2 is a side view and cross section of a part of an embodiment of a device according to the invention.

FIG. 2 is a side view and cross-section of a portion of the device 100. The engagement member 105 is laterally inserted into the main body through the side opening 116, whereby the transverse portion 125 is substantially parallel with the support member 103, which is also inserted into the main body through the bottom opening 117. The spacer 127 of the engagement member 105 engages the recessed portion 120 in the side element 109. In this partial view, two lid members 113 of the main device are shown in the closed position. Each lid member 113 closes a separate compartment 118 in the main body, and the separate compartments 118 are separated from each other by dividing elements 207. Upwardly extending bumps 201 formed on the lid members 113 may be symbols and/or numbers written in Braille for visually impaired users of the device.

When the lid members 113 are in the closed position, the hook members 115 extend through top openings 205 in the front member 111 of the main body. The hook members 115 also extend through gaps 203 formed in the front edge of engagement member 105 (see FIGS. 6A and 6E). Engagement edges 209 of the hook members 115 engage the bottom surface of engagement portions 211 of the engagement member 105, retaining or locking the lid members 113 in the closed position. The top rail member 121 of the support member 103 is disposed below the engagement member 105, giving structural integrity to the device while retaining and supporting the engagement member 105.

In this configuration, the engagement member 105 acts as a child restraint or locking mechanism for the device. The lid members 113 cannot be opened with the engagement member 105 in its present position, due to the locking engagement between the engagement face 209 of the hook member 115 and the engagement portion 211 of the front member 11. As shown in FIG. 2, the gaps 203 are slightly horizontally offset from the openings 205. Each hook member 115 is therefore constrained by the left boundary of the opening 205 and by the right boundary of the opening 203, thus holding the lid member 113 in a closed position.

In order for the hook member 115 to be released from the locking engagement, the openings 203 and 205 must be aligned substantially vertically, so that the hook member 115 is no longer held in the locking engagement position and the lid member 113 can be opened. The right boundary of the opening 203 engages the hook member 115 and thus prevents the engagement member 10s from being laterally withdrawn out of the main body of the device. Furthermore, the spacer 127 engages the recessed portion 120, thereby preventing the engagement member 105 from sliding to the right into the main body of the device. However, as will be discussed below, applying a moderate pressure to the transverse portion 125 causes it to deform slightly, and the loping mechanism may thus be released permitting the lid members 113 to be opened.

Figure 3:
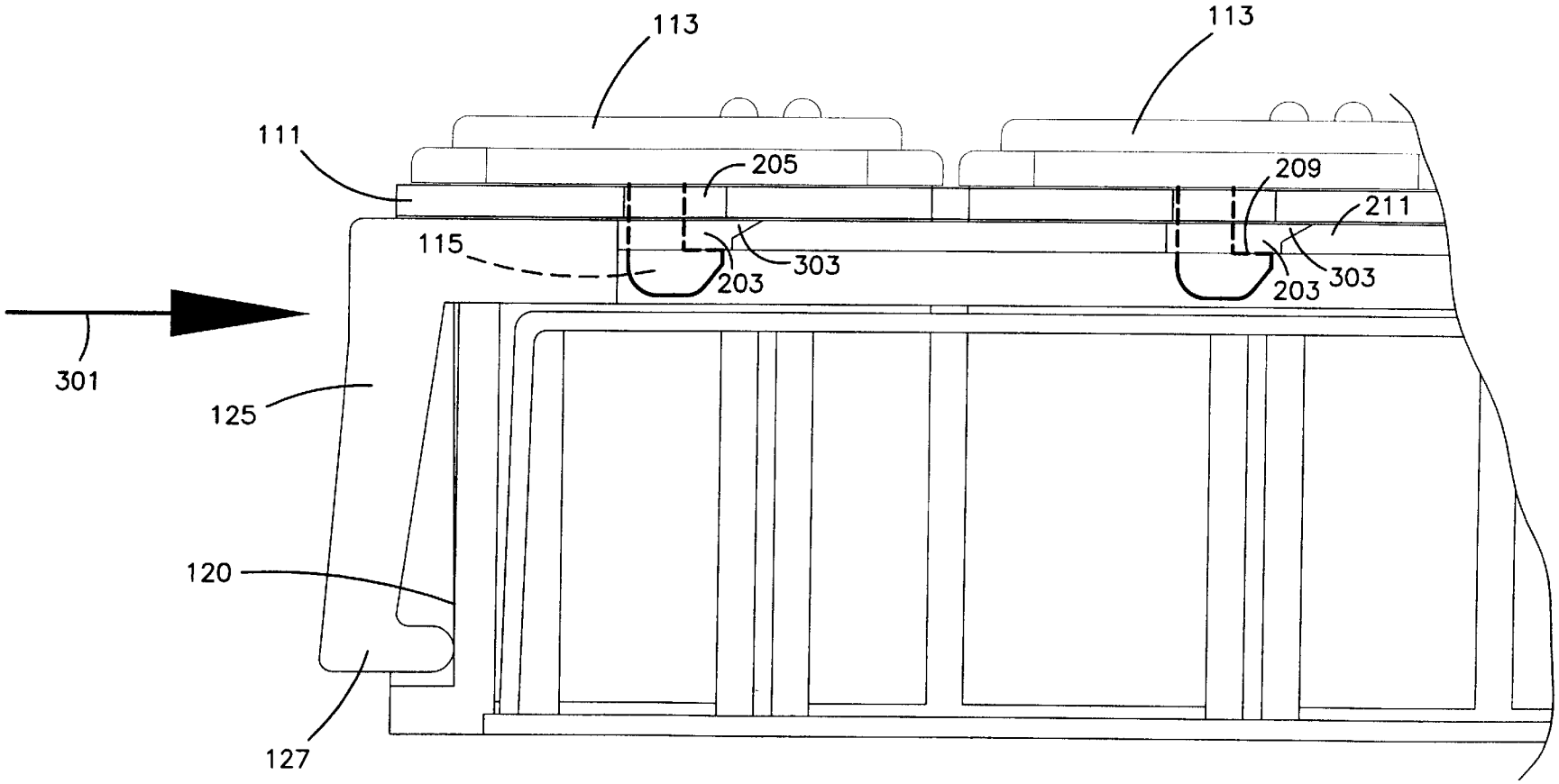
FIG. 3 is a side view and cross section of a part of an embodiment of the device according to the invention.

Referring now to FIG. 3, a moderate amount of force is shown applied to the transverse member 125, as indicated by the arrow 301. This causes the engagement member 105 to project laterally into the main body of the device. Because the spacer 127 continuously engages the recessed portion 120, the transverse portion 125 is slightly deformed during this operation. The transverse portion 125 is preferably manufactured from a resilient material, such that the moderate deformation is elastic or resilient, and the transverse portion 125 resumes its original configuration after being released. The resilience and configuration of the transverse portion 125 is typically selected such that only a moderate amount of force is necessary to dislocate the engagement member 105 satisfactorily. Preferably, a typical user of the device should be able to exert this pressure with one finger while holding the device. When pressure is applied to the engagement member 105 as indicated, the lateral movement of the engagement member 105 causes the openings 205 and 203 to be in a relatively more vertically aligned position than otherwise. When this occurs, the engagement edge 209 of the hook member 115 no longer engages the engagement portion 211 of the front member 111. Thus, the hook member 15 can be withdrawn from the openings 203 and 205. As will be further described below, it is preferable that a relatively small amount of force be used to open the lid members 113 when the engagement member 105 is in its nonlocking position and the hook members 115 are unrestrained or unlocked.

Figures 6A, 6B, 6C, 6D, 6E:
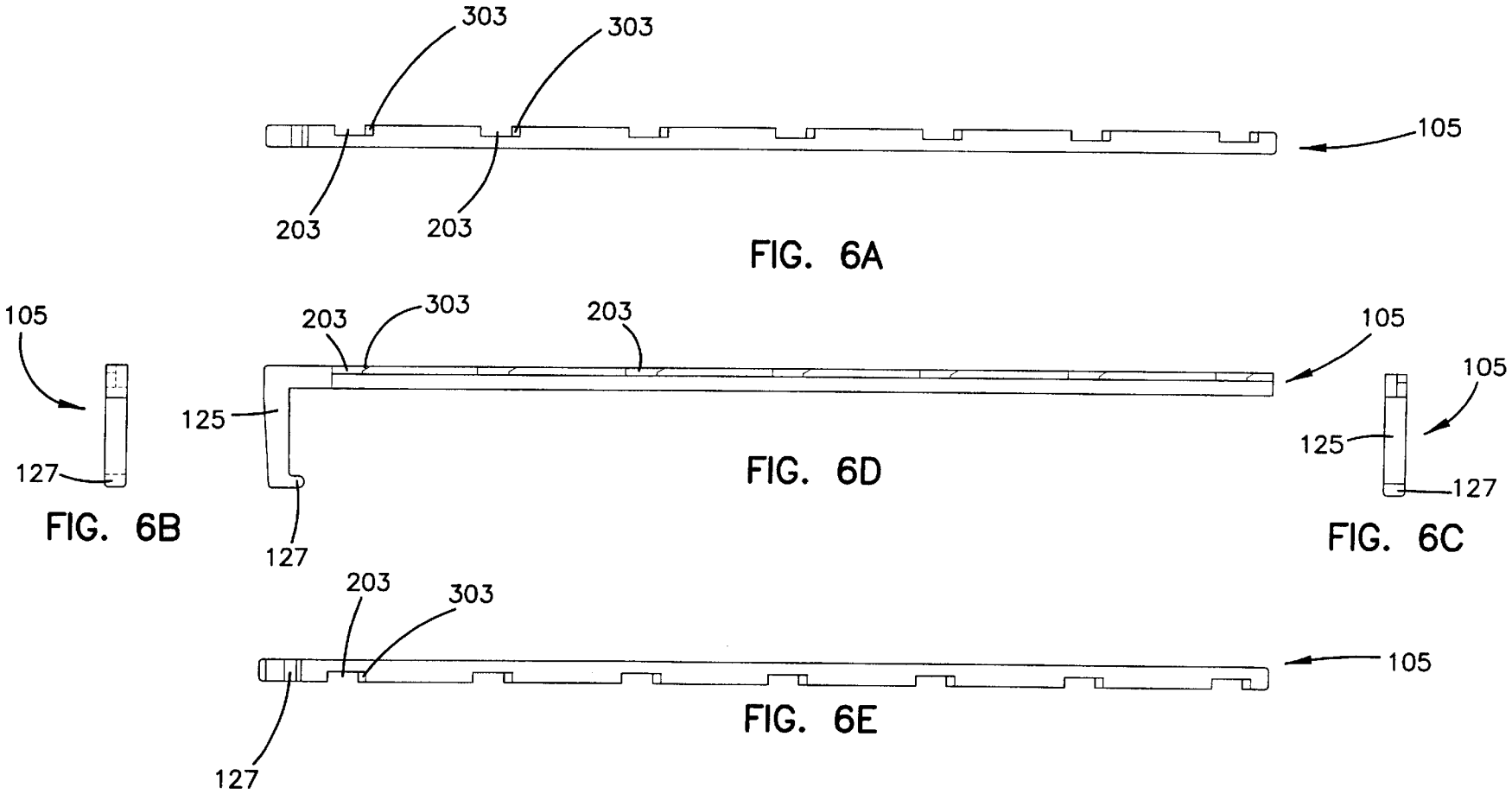
FIGS. 6A–6E are top, bottom and side views of an embodiment of an engagement member in accordance with the invention.

As shown in FIGS. 6A and 6E, a ramp portion 303 is formed at the right boundary of each of the openings 203 in the engagement member 105. When the lid members 113 are in an open position and the engagement member 105 is in its normal locking position, the ramp portion 303 facilitates the closing of the lid members 113 and the activation of the child restraint or locking mechanism. When the lid member 113 is being closed, the hook member 115 approaches the openings 205 and 203 from above. On its way down through the opening the hook member 115 engages the ramp portion 303. The force needed to close the lid members 113 is a moderate force that can easily be applied by a typical user of the device, and is of substantially the same magnitude as the force necessary to elastically deform the transverse portion 125 as described above.

The force applied to the ramp 303 by the hook member 115 serves to laterally deflect the engagement member 105 slightly. Because of the engagement between the spacer 127 and the recessed portion 120, the transverse portion 125 is slightly deformed when this occurs. Due to the deflection of the engagement member 105, the openings 203 and 205 will assume a more aligned position, and the hook member 115 can pass through both openings and the lid member 113 can assume its closed position. When the hook member 115 has passed sufficiently far through the opening 203, the engagement between the hook member 115 and the ramp 303 will cease. The engagement member 105 will then return to its original position due to the resilience of the transverse portion 125. In doing so the engagement edge 211 will engage the engagement face 209 of the hook member 115, thereby activating the locking mechanism. The engagement between the engagement edge 211 and the engagement face 209 will continue until the engagement member 205 is again dislocated by a person deactivating the locking mechanism.

With all lid members 113 in open positions, the engagement member 105 may be removed by the user by withdrawing it from the opening 116. In this manner the locking mechanism is disabled but it can be restored by reinsertion of the engagement member 105.

Figure 4B:
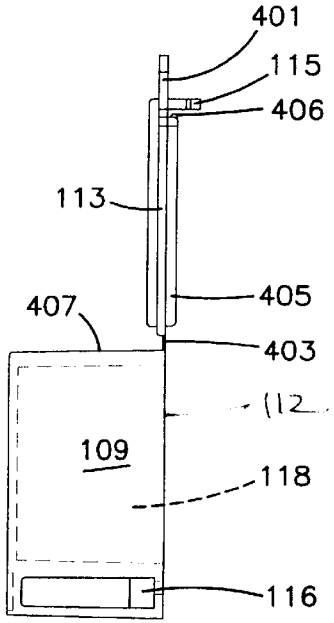
FIGS. 4A–4C are bottom, side and front views of an embodiment of the device according to the invention.
Figure 4A:
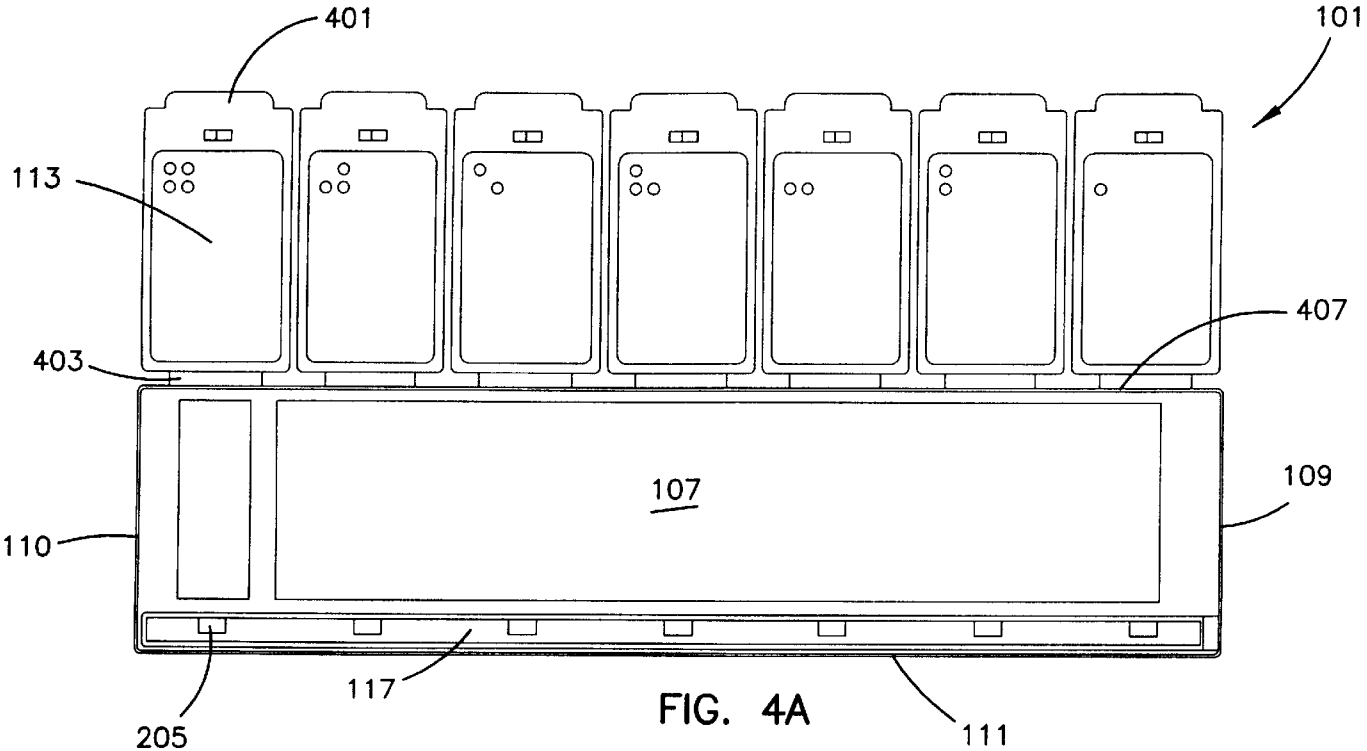
Figure 4C:
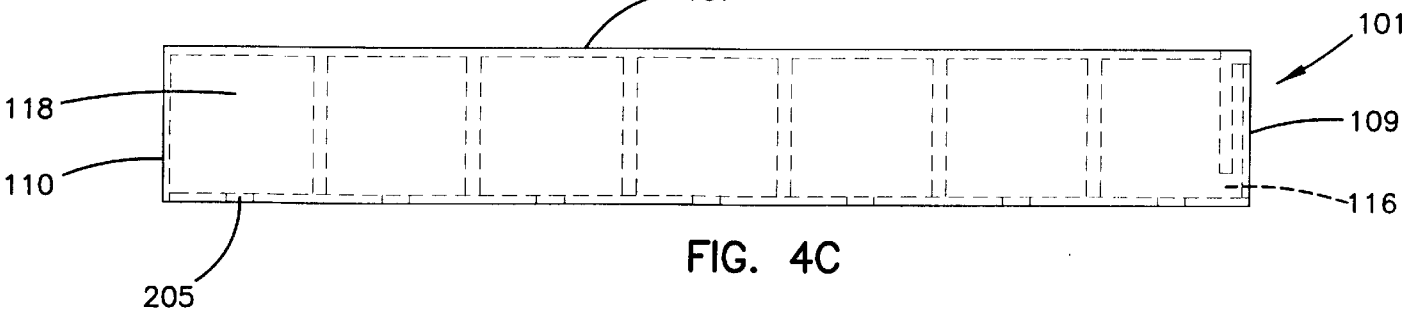
Figure 7B:
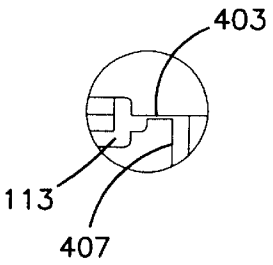
FIGS. 7A–7E are front, side and cut-out views of an embodiment of a lid member in accordance with the invention.

FIGS. 4A–4C show bottom, side and front views of the main body 101 respectively. The main body 101 is shown with seven lid members 113, all in an open position. It should be noted that although the lid members 113 are all shown in the same position, they are individually movable and can assume closed or open positions independently of each other. The lid members 113 are connected to the back element 407 of the main body 101 with hinge members 403, which in the preferred embodiment are living or integral hinges formed by the injection molding process (see also FIG. 7B). Each lid member 113 is provided with an extended portion 401. The extended portion 401 is disposed on the opposite edge of the lid member 113 in relation to the hinge member 403. The extended portion 401 is slightly narrower than the rest of the lid member 113 to facilitate its selective engagement. When the lid member 113 is in a closed position, the extended portion 401 will extend slightly over the front member 111. This provides the user of the device with a good grip against which pressure can be applied using, for example, the thumb or another finger, whereby the desired lid member 113 can be opened. The opening 117 in the bottom element 107 is formed by the front member 111 and the first and second side elements 109 and 110 respectively, as described above. The openings 205 are disposed along the top front edge of top member 112, which overlies the opening 117.

With reference to FIG. 4B, the bottom face of lid member 113 is provided with a sealing edge 405. The sealing edge 405 has a configuration corresponding to the opening of the separate compartment 118 although slightly smaller in size. When the lid member 113 is in its closed position, the sealing edge 405 extends slightly into the opening of the separate compartment 118 and forms a seal between the separate compartment and the lid member 113. The engagement between the sealing edge 405 and the opening in the separate compartment 118 helps in preventing the lid member 113 from being inadvertently opened. The sealing edge 405 includes one or more detents 406 (only one of which is shown). The detent 406 engages the interior of the separate compartment 118 and further prevents inadvertent opening of the lid member 113. Well-known detents may be used with this and other embodiments. For example, the detent 406 may be one or more bumps extending outwardly on the sealing edge 405, such that when the lid member 113 is in its closed position, the detent 406 engages the sealing edge 405 and/or the walls of the separate compartment 118. The sealing edge 405 further adds structural integrity to the lid member 113, and also adds structural integrity to the main body when the lid member 113 is in its closed position.

FIG. 4C shows the main body 101 in a front view. Seven separate compartments 118 are formed between the first and second side elements 109 and 110, respectively, and the bottom element 107. An opening 205 is situated adjacent each separate compartment 118 for the hook member (not shown) of the lid member (not shown) that corresponds to the separate compartment 118. Through the opening 116, the engagement member (not shown) will be inserted into the main body 101.

The preferred embodiment of support member 103 is shown in FIGS. 5A–5F. A side view of the support member 103 is show in FIG. 5E. The top longitudinal member 121 and the bottom longitudinal member 123 are substantially parallel in the support member 103. The transverse support ribs 119 connect the top and bottom members 121 and 123 respectively. The support ribs 119 preferably have a gradually increasing width from top to bottom, such that they may engage the inner walls of the opening 117 (not shown) when the support member 103 is inserted. As seen in the cross sectional view in 5A, the support ribs 119 have an X-shaped cross section.

Figures 5A, 5B, 5C, 5D, 5E, 5F:
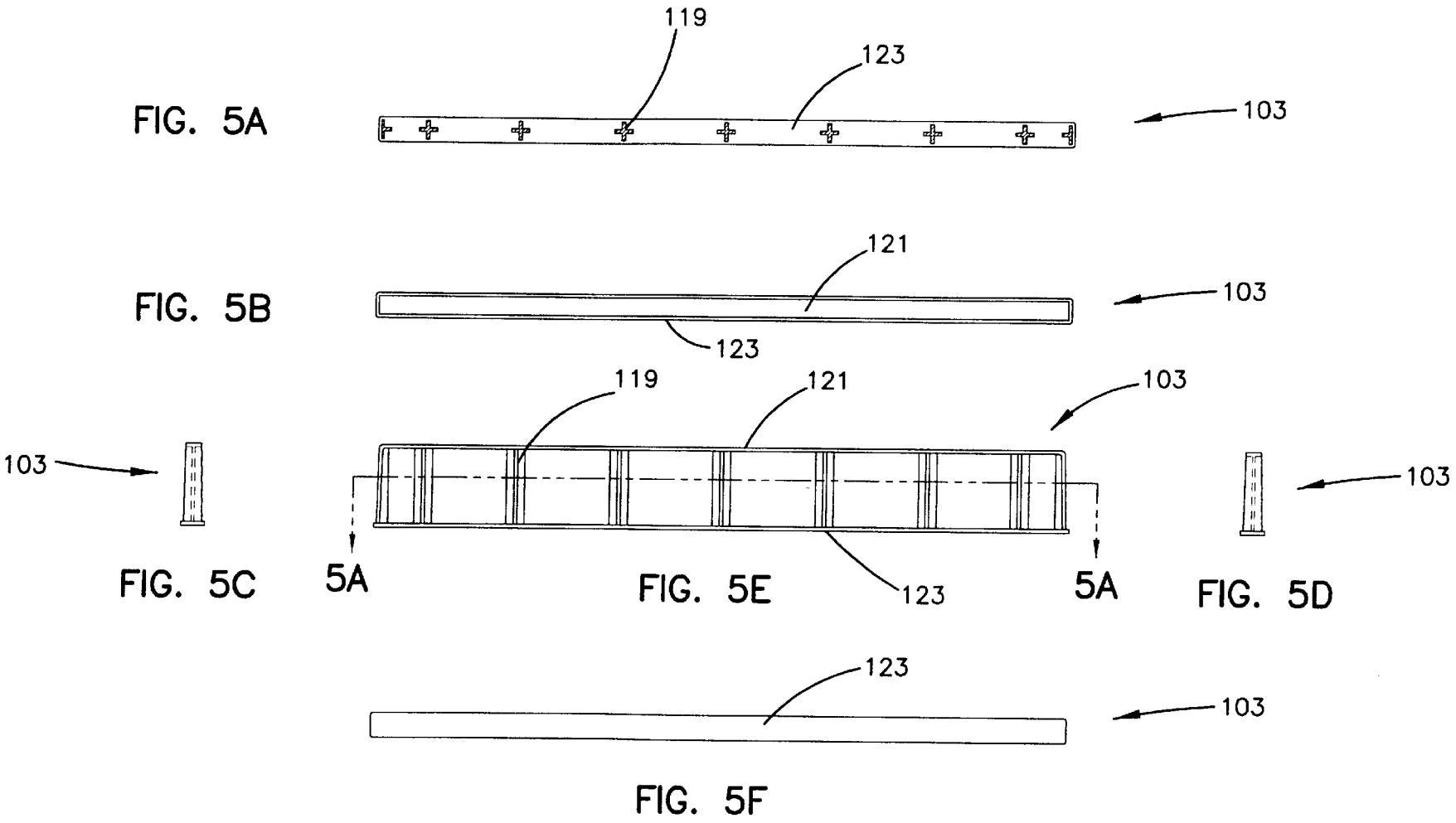
FIGS. 5A–5F are top, side and bottom views of an embodiment of a support member in accordance with the invention.

A top view of the support member 103 is shown in FIG. 5B. The top member 121 is of slightly smaller dimension than the bottom portion 123, whereby a small portion of the bottom member 123 is visible around the edge of top portion 121. This configuration aids in holding the support member 103 securely in place when inserted into the main body of the device as discussed above, and prevents the support member 103 from inadvertently being removed from the main body. Side views of the support member 103 are shown in FIGS. 5C and 5D. The support member 103 is substantially symmetrical in the two side views that are shown. A bottom view of the support member 103, wherein the bottom member 123 is visible, is shown in FIG. 5F.

Referring now to FIGS. 6A–6B, the embodiment of the engagement member 105 is shown. The gaps 203 are formed at spaced intervals over the length of engagement member 105. Adjacent each gap 203 is a corresponding ramp 303. As described above, the ramp 303 is engaged and laterally deflected by the hook members 115 (not shown) when the lid members 113 are being closed. The spacer 127 serves to hold the engagement member 105 in the locking position, preventing the lid members from being opened. The spacer 127 holds the transverse portion 125 slightly apart from the main body of the device, giving the transverse portion 125 sufficient space for elastic deformation when the user deactivates the locking mechanism.

Figure 7E:
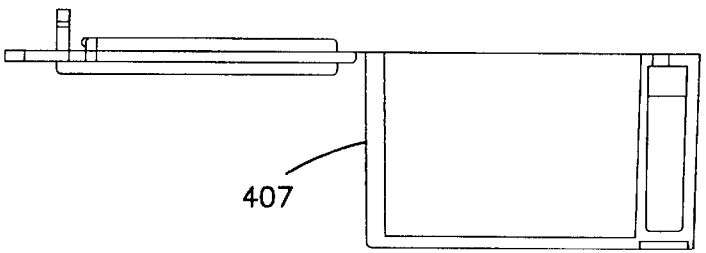
Figure 7D:
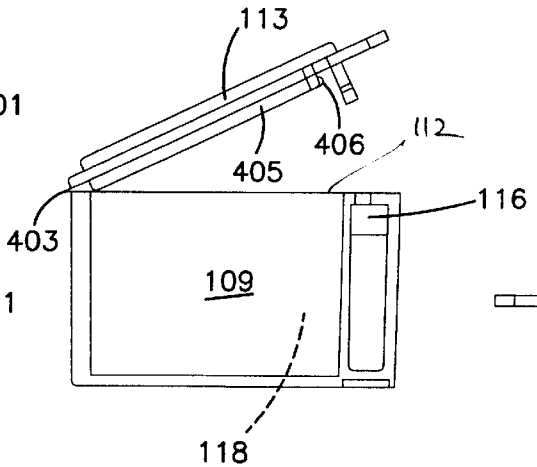
Figure 7A:
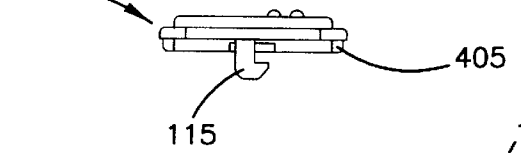
Figure 7C:
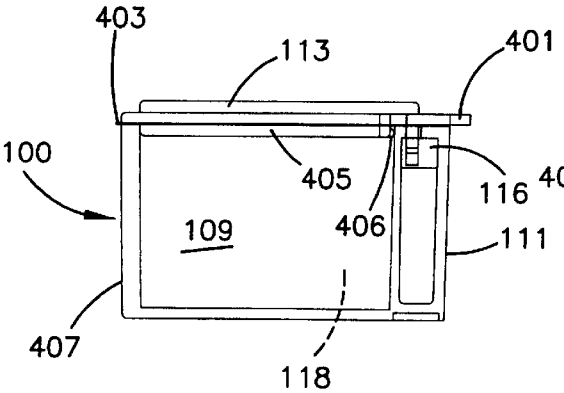

FIGS. 7A–7E further depict the operation of opening and closing the device with the locking mechanism. In FIG. 7C the device 100 is shown with the lid member 113 in a closed position. The sealing edge 405 seals the opening of the associated compartment 118. The extended portion 401 on the lid member 113 extends beyond the surface of the front member 111. This allows the user to open the lid member 113 by applying force to the extended portion 401. In FIG. 7C the device is shown without the engagement member 105. The user may remove the engagement member 105 to use the device in this configuration where the locking mechanism is temporarily deactivated. This may be convenient, for example, for a patient who keeps the pill container away from children at all times.

FIG. 7D shows the lid member 113 in an open position. The hinge member 403 allows the lid member 113 to be open at a large angle relative to the remainder of the main body, for example as shown in FIG. 7E. This allows the user accessibility to the associated compartment 118 which makes inserting and removing medical tablets easier.

When the lid member 113 is open, as shown in FIG. 7E, the user may fill the associated compartment with pills. The device 100 may be used for small objects other than pills or medical tablets, but the preferred embodiment is intended for use as a pill container. Because the device 100 comprises seven separate compartments 118, as shown in FIG. 1, the user may place pills for each day of the week in the respective compartments 118. The lid members 113 may be closed and opened individually to gain selective access to each compartment. This also reduces the chance that pills might inadvertently fall into adjacent compartments while the user is handling the device, as well as reducing the chance that the pills of one compartment might fall out from the device while a subsequent compartment is being filled with pills. When a lid member 113 is in its closed position the locking mechanism is activated if the longitudinal member 105 has been inserted into the main body, as described above. If the longitudinal member 105 has been inserted and the lid members 113 have subsequently been closed, the locking mechanism is activated and must be deactivated before opening a lid member 113 by resge longitudinal member 105 further into the main body in order to release the hook members 115 from their locked engaging positions.

In order for the locking mechanism function to be reliable and durable, the activation and deactivation of the longitudinal member 105 needs to have an appropriate range of movement. The depth of the recessed portion 120 determines the range of movement without sacrificing storage space in any of the separate compartments. Mounting the transverse portion 125 horizontally would inevitably either force the storage device to be made larger or the first separate compartment would have had to be made smaller to accommodate the transverse portion 125. The vertically oriented transverse portion 125 effectively accomplishes its function of biasing the locking mechanism into a normal locking position, and it is convenient for the user to actuate. It is also easier for the user to press the vertical transversal portion 125 with for example the thumb on the left hand than it would be to press it if it were oriented horizontally at the top of the first side element 109.

It is to be understood that even though numerous characteristics and advantages of the invention have been set forth in the foregoing description, together with details of the structure and function of the invention, the disclosure is illustrative only, and changes may be made in detail, especially in matters of shape, size and arrangement of the parts within the principles of the invention to the fall extent indicated by the broad general meaning of the terms in which the appended claims are expressed.

We claim:

1. A lockable pill container comprising:

a main body defining a plurality of separate compartments each having an open top;

a lid member for each of the compartments, each lid member being sized and constructed to overly the open top of the associated compartment;

hinge means for connecting each lid member to the main body and for permitting the lid member to be moved between open and closed positions;

each lid member further comprising an engageable first locking member that is sized and constructed to project into the main body when the lid member is in its closed position and said main body comprises a plurality of openings disposed to receive the first locking members; and a second locking member comprising a plurality of gaps disposed thereon, wherein the second locking member is carried by the main body and moveable between a first position in which it interlockably engages the first locking members of closed lid members and a second position in which it is disengaged from said first locking members, the second locking member comprising a transverse member disposed externally of the main body and projecting downward, the transverse member being engageable by a user to move the second locking member between said first and second positions.

2. The pill container defined by claim 1, which further comprises biasing means for normally urging the second locking member into its first position.

3. The pill container defined by claim 1, wherein the transverse member is formed from resilient material and comprises a free end that engageably abuts the main body to normally bias the second locking member into its first position, the transverse member being constructed and arranged to be manually pressed against its normal bias to move the second locking member to its second position and thereby release the lid members from lockable engagement.

4. The pill container defined by claim 1, wherein the main body is elongated and the compartments are linearly arranged.

5. The pill container defined by claim 4, wherein the main body comprises seven compartments.

6. The pill container defined by claim 4, wherein the main body comprises an elongated passage terminating in an externally accessible opening, the elongated passage being sized and configured to receive the second locking means, and the second locking means is removably insertable into the elongated passage through said opening.

7. The pill container defined by claim 6, wherein the main body is generally rectangular and comprises left and right ends, a front, back and bottom, the opening to the elongated passage being disposed in one of said left and right ends.

8. The pill container defined by claim 5, wherein said one of said left and right ends comprises a vertically disposed recess to receive the transverse member of said second locking member.

9. The pill container defined by claim 7, wherein the main body further comprises a generally vertically oriented elongated passage disposed adjacent the front of said main body and under elongated passage for said second locking member, said generally vertically oriented elongated passage being accessible through an elongated opening in the bottom of said main body, and said pill container further comprises an elongated support member insertable into said generally vertically oriented elongated passage in underlying relation to said second locking member to support the second locking member as it is moved between its first and second positions.

10. The pill container defined by claim 9, wherein said substantially vertically oriented elongated passage and said support member are constructed so that the support member is frictionally retained within said passage.

11. The pill container defined by claim 10, wherein the substantially vertically oriented elongated passage is of substantially uniform cross section and the support member is tapered in cross section.

12. The pill container defined by claim 1, wherein each of said first locking members comprises a hooking member that projects substantially vertically downward from the associated lid member.

13. The pill container defined by claim 12, wherein said plurality of openings of the main body are disposed to receive the respective hook members.

14. The pill container defined by claim 13, wherein the plurality of gaps of the second locking member corresponding generally in size to the openings for said hook members, said gaps being in substantially full alignment with said hook member openings when the second locking member is in its second position, said gaps being in partial alignment with said hook member openings when the second locking member is in its first position.

15. The pill container defined by claim 14, wherein said second locking member further comprises a ramp surface engageable with said hook members when said second locking member is in its first position, the ramp surface being constructed and arranged to laterally deflect said hook members upon said engagement permitting the hook member to project into its associated gap and to be engageably locked by said second locking member.

16. The pill container defined by claim 1, wherein each of said lid members comprises an extended portion that projects beyond the main body when in its closed position, enabling a user to open the lid member by engaging said extended portion.

17. The pill container defined by claim 1, wherein each of said lid members further comprises detent means for retaining the lid member in its closed position.

* * * * *